US009238909B2

(12) United States Patent
Imai et al.

(10) Patent No.: US 9,238,909 B2
(45) Date of Patent: Jan. 19, 2016

(54) COLUMN BASE JOINT STRUCTURE

(71) Applicants: SUMITOMO FORESTRY CO., LTD., Tokyo (JP); KANAI CO., LTD., Tokyo (JP)

(72) Inventors: Junichi Imai, Tokyo (JP); Kunio Kanai, Tokyo (JP); Masayoshi Nakamura, Tokyo (JP)

(73) Assignees: SUMITOMO FORESTRY CO., LTD., Tokyo (JP); KANAI CO., LTD., Tokyo (JP)

( * ) Notice: Subject to any disclaimer, the term of this patent is extended or adjusted under 35 U.S.C. 154(b) by 0 days.

(21) Appl. No.: 14/501,068

(22) Filed: Sep. 30, 2014

(65) Prior Publication Data

US 2015/0107183 A1 Apr. 23, 2015

(30) Foreign Application Priority Data

Oct. 22, 2013 (JP) ..... 2013-219218

(51) Int. Cl.

| | |
|---|---|
| ***E04C 2/38*** | (2006.01) |
| ***E04B 1/41*** | (2006.01) |
| *E04C 3/30* | (2006.01) |
| *E04B 1/26* | (2006.01) |

(52) U.S. Cl.

CPC ..... *E04B 1/4157* (2013.01); *E04B 1/2604* (2013.01); *E04B 2001/2628* (2013.01); *E04B 2001/2636* (2013.01); *E04B 2001/2664* (2013.01); *E04B 2001/2684* (2013.01); *E04C 3/30* (2013.01)

(58) Field of Classification Search

CPC ..... E04B 1/2604; E04B 2001/2636; E04B 2001/2684; E04B 2001/268; E04B 1/4157; E04B 2001/2463; E04H 12/2253; E04C 3/30

USPC ..... 52/656.9

See application file for complete search history.

(56) References Cited

U.S. PATENT DOCUMENTS

| | | | | | |
|---|---|---|---|---|---|
| 1,445,938 | A | * | 2/1923 | Farrington | 52/295 |
| 1,668,486 | A | * | 5/1928 | Betts | 52/298 |
| 2,625,815 | A | * | 1/1953 | Black | 52/126.1 |
| 2,815,937 | A | * | 12/1957 | Curtze et al. | 256/23 |
| 3,503,584 | A | * | 3/1970 | Erhart et al. | 249/205 |
| 4,240,766 | A | * | 12/1980 | Smith et al. | 404/10 |

(Continued)

FOREIGN PATENT DOCUMENTS

JP 3488870 1/2004

*Primary Examiner* — Basil Katcheves
*Assistant Examiner* — Joshua Ihezie
(74) *Attorney, Agent, or Firm* — Young & Thompson

(57) ABSTRACT

In a column base joint structure, an anchor bolt and a column installed upright on a groundsel are tightly joined using groundsel-side and column-side hardware pieces. The groundsel-side hardware piece includes groundsel-embedded and upper fitting tenon portions. A fitting hole for the upper fitting tenon portion of the groundsel-side hardware piece is formed in a base of the column. The column-side hardware piece includes a lower projecting portion projecting downward from a top face portion to the inside of the fitting hole, and a column-embedded portion positioned above the top face portion. A pin locking hole in the upper fitting tenon portion of the groundsel-side hardware piece and a pin locking hole in the lower projecting portion of the column-side hardware piece are mutually aligned, a driftpin is hammered into the aligned pin locking holes, and the anchor bolt and the column are thereby tightly joined to each other.

10 Claims, 6 Drawing Sheets

(56) References Cited

U.S. PATENT DOCUMENTS

| | | | | | |
|---|---|---|---|---|---|
| 4,558,968 | A | * | 12/1985 | Meickl | 403/174 |
| 4,795,294 | A | * | 1/1989 | Takada et al. | 411/457 |
| 4,869,467 | A | * | 9/1989 | Kellison | 256/64 |
| 5,342,138 | A | * | 8/1994 | Saito et al. | 403/189 |
| 5,375,384 | A | * | 12/1994 | Wolfson | 52/295 |
| 5,419,538 | A | * | 5/1995 | Nicholas et al. | 256/65.14 |
| 5,438,811 | A | * | 8/1995 | Goya | 52/702 |
| 5,501,048 | A | * | 3/1996 | Nakanishi | 52/296 |
| 5,577,856 | A | * | 11/1996 | Tezuka | 403/294 |
| 5,617,694 | A | * | 4/1997 | Baba | 52/712 |
| 5,636,934 | A | * | 6/1997 | Nakanishi et al. | 403/230 |
| 5,666,774 | A | * | 9/1997 | Commins | 52/298 |
| 5,823,701 | A | * | 10/1998 | Goto | 403/268 |
| 5,845,453 | A | * | 12/1998 | Goya | 52/702 |
| 5,921,049 | A | * | 7/1999 | Sugiyama | 52/653.1 |
| 6,032,431 | A | * | 3/2000 | Sugiyama | 52/656.9 |
| 6,290,212 | B1 | * | 9/2001 | Bartel | 256/65.14 |
| 6,367,224 | B1 | * | 4/2002 | Leek | 52/704 |
| 7,520,485 | B1 | * | 4/2009 | Giannetto | 248/530 |
| 7,637,076 | B2 | * | 12/2009 | Vaughn | 52/838 |
| 8,333,048 | B2 | * | 12/2012 | Talpe | 52/745.21 |
| 8,511,033 | B2 | * | 8/2013 | Kumakawa et al. | 52/656.9 |
| D700,506 | S | * | 3/2014 | Kumakawa et al. | D8/382 |
| D708,935 | S | * | 7/2014 | Kumakawa et al. | D8/382 |
| 2005/0023432 | A1 | * | 2/2005 | Huber et al. | 249/34 |
| 2005/0252124 | A1 | * | 11/2005 | Bergman | 52/296 |
| 2008/0307739 | A1 | * | 12/2008 | Clucas | 52/580 |

* cited by examiner

COLUMN BASE JOINT STRUCTURE

TECHNICAL FIELD

The present invention relates to a column base joint structure, and particularly to a column base joint structure that tightly joins an anchor bolt, whose upper-end male screw portion projects from the upper face of a foundation, with a column installed upright on a groundsel.

BACKGROUND ART

Known examples of structures for tightly joining a foundation and a column installed upright on a groundsel installed on the upper face of the foundation with each other in a wooden building, such as a wooden residential building, include, for example, structures in which an upper-end male screw portion of an anchor bolt projecting from the upper face of a foundation is fastened to a hold-down hardware piece attached to a side face of the base portion of a column. Unfortunately, such a hold-down hardware piece attached to the side face of a column base portion may be problematic; e.g., the hold-down hardware piece may hinder the attaching of a diagonal beam, or may constitute a heat bridge. For this reason, a column base joint structure in which column base fittings for tightly joining a column with an anchor bolt are embedded respectively in the column's base portion and a groundsel has been developed as a structure that replaces the hold-down hardware piece (e.g., see JP3488870 B).

In the column base joint structure disclosed in JP3488870 B, the column base fitting is constituted by: a cylindrical groundsel-embedded portion that is embedded in a groundsel and is tightly joined to an anchor bolt; and a tenon portion—which is provided separately from the groundsel-embedded portion—that has a columnar engaging portion projecting downward and is fixed to a bottom face portion of a column. After the groundsel is installed on the upper face of a foundation, the engaging portion of the tenon portion projecting from the column's bottom face portion is fitted into the groundsel-embedded portion, and thereby, a connecting hole formed in the engaging portion of the tenon portion is aligned with a connecting hole formed in the groundsel-embedded portion in a state where the column is installed upright on the groundsel, and the anchor bolt and the column are tightly joined with each other by hammering a locking pin into the connecting holes.

SUMMARY OF INVENTION

Technical Problem

However, with the column base joint structure using the column base fitting disclosed in JP3488870 B, the locking pin hammered into the aligned connecting holes of the tenon portion and of the groundsel-embedded portion needs to be hammered in from a side face of the groundsel. Therefore, for example, in a state where an underfloor panel is provisionally laid so as to be supported by the upper face of the groundsel and a scaffold is formed, it is difficult to tightly join the anchor bolt and the column with each other by hammering-in the locking pin from the side face of the groundsel, because the provisionally-laid underfloor panel becomes a hindrance.

Moreover, it is difficult in some cases to join an end face of another groundsel, or an end face of a beam member such as a sleeper, to a side face or an end face of a groundsel in a portion where a column is installed upright because of the relationship between these parts and a hammering hole into which the locking pin is hammered, and it is also difficult in some cases to attach a joint hardware piece serving as a connector or a joint.

An objective of the present invention is to provide a column base joint structure with which it is possible to tightly join an anchor bolt and a column to each other easily by using hardware pieces for tight joining which are embedded respectively in the column's base portion and a groundsel, even in a state where, for example, an underfloor panel is provisionally laid on the upper face of the groundsel, and with which it is also possible to join an end face of another groundsel or a beam member, or to attach a joint hardware piece serving as a connector or a joint, to a side face or an end face of a groundsel in a portion where the column is installed upright, without the need to consider the relationship between these parts and a hammering hole into which a locking pin is hammered.

Solution to Problem

The present invention achieves the aforementioned objective by providing a column base joint structure in which a column installed upright on a groundsel and an anchor bolt having an upper-end male screw portion projecting from an upper face of a foundation are tightly joined to each other by using a groundsel-side hardware piece attached to the groundsel and a column-side hardware piece attached to the column. The groundsel-side hardware piece is a tubular hardware piece placed in and fixed to a placement hole formed so as to vertically penetrate the groundsel. The groundsel-side hardware piece includes, within a hollow interior thereof, a fastening step portion to which the anchor bolt is fastened. The groundsel-side hardware piece has: a groundsel-embedded portion that is embedded in the groundsel; and an upper fitting tenon portion that projects upward from an upper face of the groundsel and in which a pin locking hole is formed. The column has, in its lower end portion, a fitting hole into which the upper fitting tenon portion of the groundsel-side hardware piece is fitted, the fitting hole being formed by depressing a lower end face of the column in a mortise shape. The column-side hardware piece is a rod-shaped hardware piece attached so as to extend along a central axis direction of the column, and the column-side hardware piece has: a lower projecting portion that has a pin locking hole and is formed so as to project downward to the inside of the fitting hole, which is formed in the column, from a top face portion of the fitting hole; and a column-embedded portion that is embedded in and fixed to a portion of the column above the top face portion of the fitting hole. The anchor bolt and the column are tightly joined to each other by: fastening the anchor bolt to the fastening step portion of the groundsel-side hardware piece, to fix the groundsel to the foundation; fitting the upper fitting tenon portion projecting from the upper face of the groundsel into the fitting hole, to install the column upright on the groundsel; aligning the pin locking hole in the upper fitting tenon portion of the groundsel-side hardware piece with the pin locking hole in the lower projecting portion of the column-side hardware piece; and hammering a locking pin into the pin locking holes.

In the column base joint structure of the present invention, it is preferable that: the column-side hardware piece includes, at a base end portion of the lower projecting portion, an overhanging flange provided so as to project outward from an outer circumferential face of the lower projecting portion, the overhanging flange having an outer diameter that is substantially the same as the inner diameter of the upper fitting tenon portion of the groundsel-side hardware piece; and the locking pin is hammered into the aligned pin locking holes in a state where the overhanging flange is arranged on the inner side of the upper fitting tenon portion.

In the column base joint structure of the present invention, it is also preferable that: a rotation locking recess portion is formed by making a cut in an upper end face of the upper fitting tenon portion of the groundsel-side hardware piece; a rotation locking projecting portion is provided so as to project radially outward from a peripheral edge portion of the overhanging flange of the column-side hardware piece; and the overhanging flange is arranged on the inner side of the upper fitting tenon portion in a state where the rotation locking projecting portion is engaged in and locked by the rotation locking recess portion.

Furthermore, in the column base joint structure of the present invention, it is preferable that a joint hardware piece is attached to a side face or an end face of a portion of the groundsel to which the groundsel-side hardware piece is attached.

Furthermore, in the column base joint structure of the present invention, it is preferable that: a female screw hole is formed in a circumferential face of the groundsel-embedded portion of the groundsel-side hardware piece; and a male screw portion of a fixing bolt that fixes the joint hardware piece to the side face or the end face of the groundsel is fastened to the female screw hole.

Advantageous Effects of Invention

According to the column base joint structure of the present invention, it is possible to tightly join an anchor bolt and a column to each other easily by using hardware pieces for tight joining which are embedded respectively in the column's base portion and a groundsel, even in a state where, for example, an underfloor panel is provisionally laid on the upper face of the groundsel, and it is also possible to join an end face of another groundsel or a beam member, or to attach a joint hardware piece serving as a connector or a joint, to a side face or an end face of a groundsel in a portion where the column is installed upright, without the need to consider the relationship between these parts and a hammering hole into which a locking pin is hammered.

DESCRIPTION OF EMBODIMENTS

Figure 1:
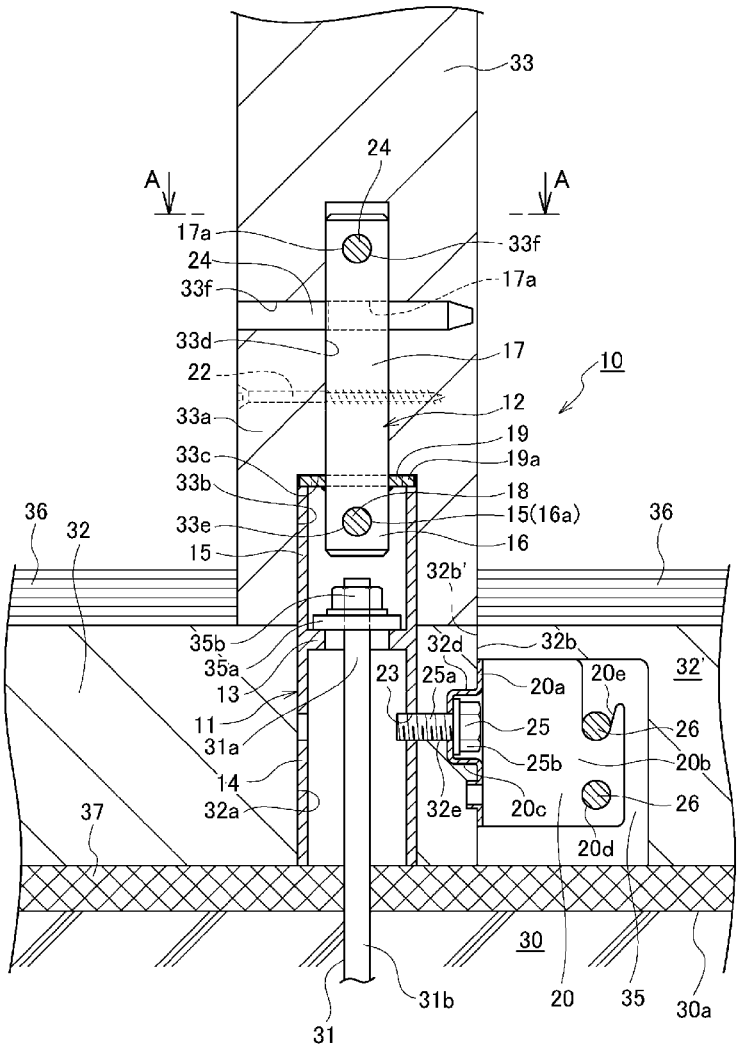
FIG. 1 is a front view obtained by viewing FIG. 2 from below, for illustrating a column base joint structure according to a preferable embodiment of the present invention in a state where a groundsel and a column are illustrated transparently.
Figure 2:
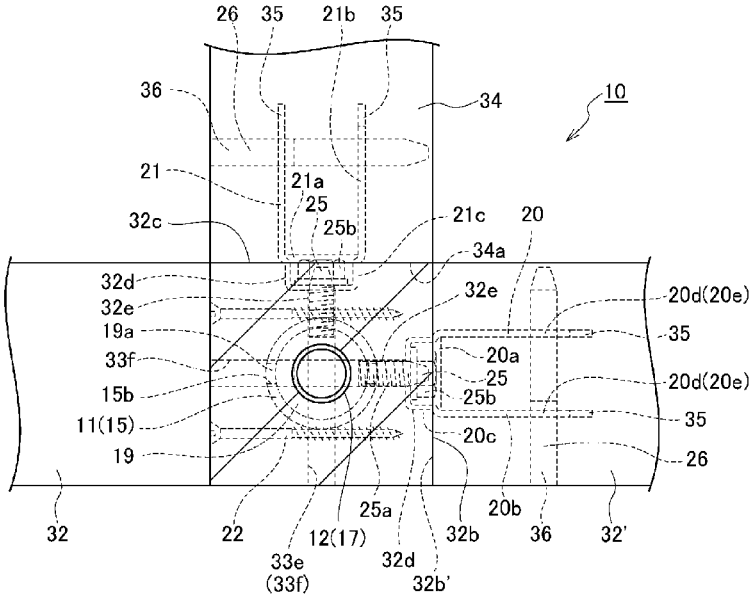
FIG. 2 is a cross-sectional view taken along line A-A in FIG. 1, for illustrating the column base joint structure according to a preferable embodiment of the present invention in the state where the groundsel and the column are illustrated transparently.
Figure 3:
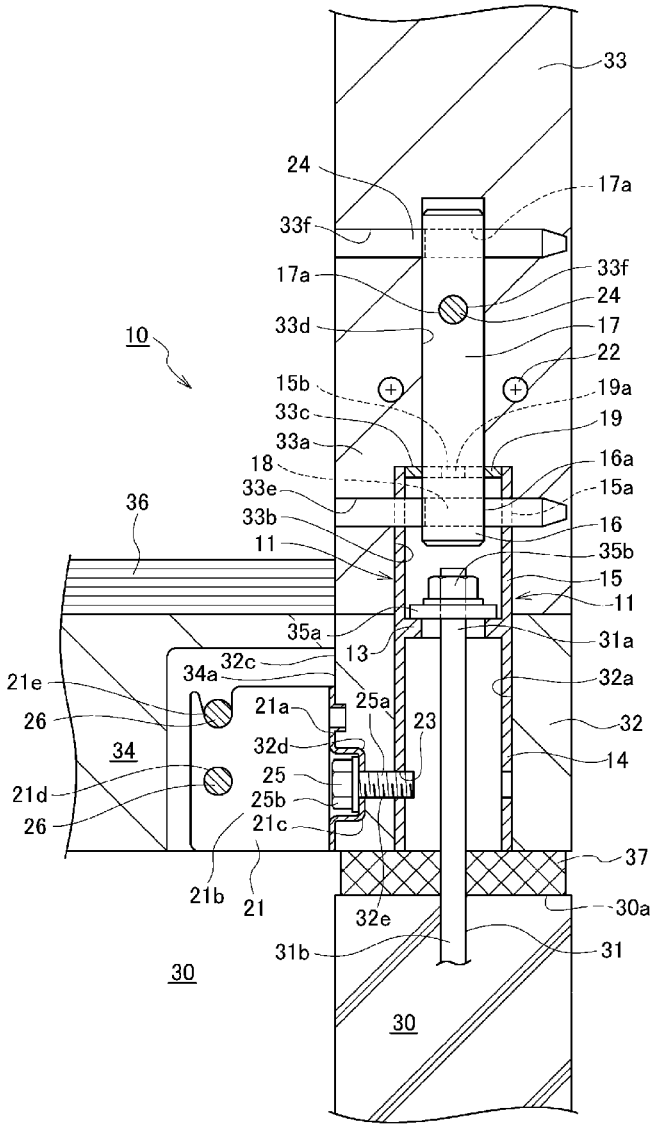
FIG. 3 is a side view obtained by viewing FIG. 1 from the left side, for illustrating the column base joint structure according to a preferable embodiment of the present invention in the state where the groundsel and the column are illustrated transparently.

A column base joint structure 10 according to a preferable embodiment of the present invention illustrated in FIGS. 1 to 3 is employed as a structure for tightly joining an anchor bolt 31, which is embedded in and fixed to a concrete foundation 30, with a column 33, which is installed upright on a groundsel 32 provided on the upper face of the foundation 30, by using hardware pieces 11 and 12 for tight joining, and firmly joining and integrating the foundation 30, the groundsel 32, and the base portion 33*a* of the column 33 with one another in a wooden residential building, for example, to thereby stably provide a proof strength necessary in the base portion 33*a* of the column 33. Furthermore, the column base joint structure 10 of the present embodiment allows the anchor bolt 31 and the column 33 to be tightly joined with each other easily and smoothly by employing, as tight-joining hardware pieces, a groundsel-side hardware piece 11 and a column-side hardware piece 12 that are attached respectively to the groundsel 32 and the column 33 in advance in a factory or the like, and using those tight-joining hardware pieces 11 and 12 in a state where they are embedded respectively inside the groundsel 32 and the column 33, which results in less time and effort required at a construction site. The column base joint structure 10 of the present embodiment also allows the joining operation to be performed more easily by using, as a scaffold, an underfloor panel 36 that is provisionally laid so as to be supported by the upper face of the groundsel 32, for example.

Figure 4A:
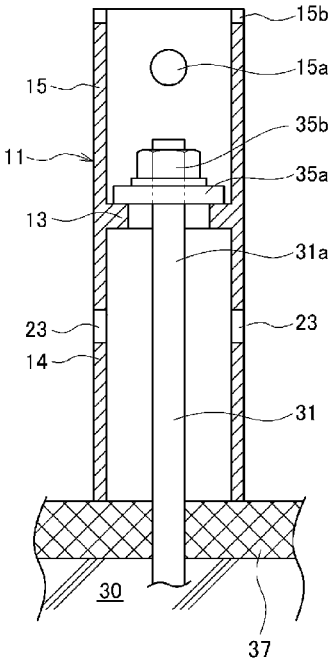
FIG. 4A is a cross-sectional view in a state where an anchor bolt is fastened to a groundsel-side hardware piece attached to the groundsel.
Figure 4B:
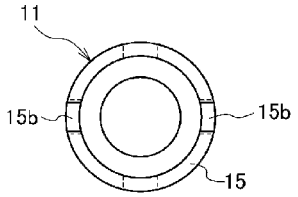
FIG. 4B is a top view of the groundsel-side hardware piece.
Figure 5A:
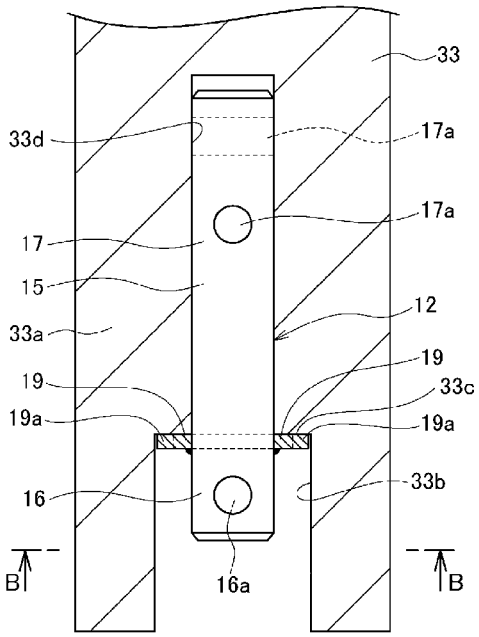
FIG. 5A is a cross-sectional view of a column-side hardware piece attached to a column.
Figure 5B:
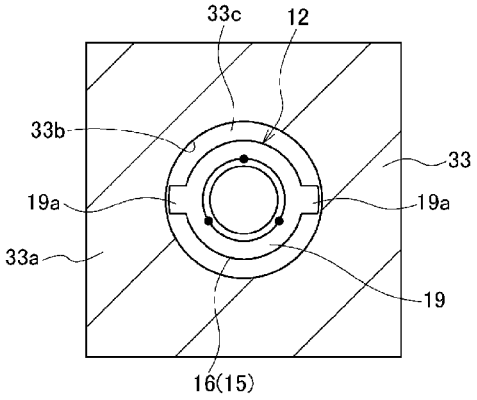
FIG. 5B is a cross-sectional view taken along line B-B in FIG. 5A.

As illustrated in FIGS. 1 to 3, the column base joint structure 10 of the present invention is a joint structure in which the column 33 installed upright on the groundsel 32 and the anchor bolt 31 having an upper-end male screw portion 31*a* projecting from an upper face 30*a* of the foundation 30 are tightly joined to each other by using the groundsel-side hardware piece 11 attached to the groundsel 32 and the column-side hardware piece 12 attached to the column 33. The groundsel-side hardware piece 11 is made of a tubular hardware piece that is placed in and fixed to a placement hole 32*a* formed so as to vertically penetrate the groundsel 32. As also illustrated in FIGS. 4A and 4B, the groundsel-side hardware piece 11 includes, in its hollow interior, a fastening step portion 13 to which the anchor bolt 31 is fastened, and the groundsel-side hardware piece 11 also has: a groundsel-embedded portion 14 that is embedded in the groundsel 32; and an upper fitting tenon portion 15 that projects upward from the upper face of the groundsel 32 and in which pin locking holes 15*a* are formed. As also illustrated in FIGS. 5A and 5B, the base portion 33*a*, which is a lower end portion of the column 33, has a fitting hole 33*b* that is formed by depressing the lower end face of the column 33 in a mortise shape and into which the upper fitting tenon portion 15 of the groundsel-side hardware piece 11 is fitted. The column-side hardware piece 12 is made of a rod-shaped hardware piece attached so as to extend along the central axis direction of the column 33, and has: a lower projecting portion 16 that has a pin locking hole 16*a* and is formed so as to project downward to the inside of the fitting hole 33*b*, which is formed in the column 33, from a top face portion 33*c* of the fitting hole 33*b*; and a column-embedded portion 17 embedded in and fixed to a portion of the column 33 above the top face portion 33*c*. The anchor bolt 31 is fastened to the fastening step portion 13 of the groundsel-side hardware piece 11, to fix the groundsel 32 to the foundation 30; the upper fitting tenon portion 15 projecting from the upper face of the groundsel 32 is fitted into the fitting hole 33*b*, to install the column 33 upright on the groundsel 32; the pin locking holes 15*a* of the upper fitting tenon portion 15 of the groundsel-side hardware piece 11 are aligned with the pin locking hole 16*a* of the lower projecting portion 16 of the column-side hardware piece 12; and a locking pin 18, preferably a driftpin, is hammered into these pin locking holes. Thus, the anchor bolt 31 and the column 33 are tightly joined to each other (see FIGS. 6A and 6B).

In the present embodiment, the column-side hardware piece 12 includes, at a base end portion of the lower projecting portion 16, an overhanging flange 19 that is provided so as to project outward from the outer circumferential face of the lower projecting portion 16, and that has an outer diameter which is substantially the same as the inner diameter of the upper fitting tenon portion 15 of the groundsel-side hardware piece 11. The driftpin 18 is hammered into the aligned pin locking holes 15*a* and 16*a* in a state where the overhanging flange 19 is arranged on the inner side of the upper fitting tenon portion 15.

Furthermore, in the present embodiment, rotation locking recess portions 15*b* are formed by making cuts in the upper end face of the upper fitting tenon portion 15 of the groundsel-side hardware piece 11 (see FIGS. 4A and 4B), and rotation locking projecting portions 19*a* are provided so as to project radially outward from the peripheral edge portion of the overhanging flange 19 of the column-side hardware piece 12 (see FIGS. 5A and 5B). The overhanging flange 19 is arranged on the inner side of the upper fitting tenon portion 15 in a state where the rotation locking projecting portions 19*a* are engaged in and locked by the rotation locking recess portions 15*b*.

In the present embodiment, the foundation 30 is a continuous footing made of reinforced concrete, for example. As illustrated in FIGS. 1 and 3, an embedding fixation portion 31*b* of the anchor bolt 31 is embedded in the foundation 30 with an appropriate embedding length, and the upper-end male screw portion 31*a* of the anchor bolt 31 projects from the upper face 30*a* of the foundation 30 by a length of about 140 mm, for example. In this state, a plurality of anchor bolts 31 are arranged at a predetermined pitch in the extending direction of the foundation 30. The groundsel 32 is installed so as to be overlaid on the upper face 30*a* of the foundation 30, preferably in a state where a spacer member 37 having a thickness of about 20 mm, for example, for keeping an airway is interposed between the groundsel 32 and the foundation 30.

In the present embodiment, the groundsel 32 is made of a wooden square timber of 105 mm×105 mm, for example. The groundsel 32 has a plurality of anchor bolt fastening holes (not shown) that are formed at the same arrangement pitch as that of the anchor bolts 31 so as to vertically penetrate the groundsel 32, and, at sections where columns 33 are to be installed upright, hardware piece placement holes 32*a* each having a circular cross-section with an inner diameter of about 52 mm, for example, are opened so as to vertically penetrate the groundsel 32. The groundsel-embedded portion 14 of the groundsel-side hardware piece 11 is joined and fixed to each hardware piece placement hole 32*a* so as to be closely fitted therein, in advance at a factory or the like.

In the present embodiment, the groundsel-side hardware piece 11 is attached to the hardware piece placement hole 32*a* formed at an end portion of the groundsel 32. As also illustrated in FIG. 2, an end face 32*b*' of another groundsel 32' is joined to the end portion of the present groundsel 32 so as to extend along the axial direction from the end face 32*b* of the groundsel 32, and an end face 34*a* of a beam member 34, such as a sleeper, is joined so as to extend along the vertical direction from a side face 32*c* of the groundsel 32. For this reason, in the present embodiment, bolt fastening recess portions 32*d* and bolt insertion holes 32*e* for attaching later-described joint hardware pieces 20 and 21 are formed in the end face 32*b* and the side face 32*c* of the end portion of the groundsel 32.

In the present embodiment, the column 33 is a wooden square timber of 105 mm×105 mm, for example. The base portion 33*a* that is the lower end portion of the column 33 has the aforementioned fitting hole 33*b* formed by depressing the center portion of the lower end face in a mortise shape. The fitting hole 33*b* has a circular cross-section having an inner diameter of about 52 mm, for example, which is substantially the same as the hardware piece placement hole 32*a* formed in the groundsel 32, and the fitting hole 33*b* is formed to have a depth of about 65 mm, for example, which is substantially the same as the length of the later-described upper fitting tenon portion 15 of the groundsel-side hardware piece 11.

The column 33 also has a hardware piece fixation hole 33*d* that is formed by drilling further upward from the fitting hole's top face portion 33*c*—which is the deepest portion of the fitting hole 33*b* in the depth direction—and that has a circular cross-section with a diameter which is smaller than that of the fitting hole 33*b*. The hardware piece fixation hole 33*d* is formed so as to be arranged concentrically with the fitting hole 33*b*. The hardware piece fixation hole 33*d* has an inner diameter that is substantially the same as the outer diameter of the column-side hardware piece 12, which is a rod-shaped hardware piece having a circular cross-section, and is formed to have a depth that is slightly deeper than the length of the column-embedded portion 17 of the column-side hardware piece 12. The column-embedded portion 17 of the column-side hardware piece 12 is joined and fixed to the hardware piece fixation hole 33*d* so as to be closely fitted therein, in advance at a factory or the like, and is thereby attached to the base portion 33*a* of the column 33 in a state where the lower projecting portion 16 of the column-side hardware piece 12 projects to the inside of the fitting hole 33*b* from the top face portion 33*c*.

Furthermore, the base portion 33*a* of the column 33 has a locking pin hammering hole 33*e* that is provided so as to penetrate a pair of side walls of the column 33 opposing one another, and into which the driftpin 18 is hammered toward the pin locking holes 15*a* in the upper fitting tenon portion 15 of the groundsel-side hardware piece 11 and the pin locking hole 16*a* in the lower projecting portion 16 of the column-side hardware piece 12 with the central axes of the pin locking holes 15*a* and 16*a* aligned with one another inside the fitting hole 33*b*. In the base portion 33*a* of the column 33, fixing pin hammering holes 33*f* for fixing the column-side hardware piece 12 are also provided at height-wise positions at which the hardware piece fixation hole 33*d* is formed, the fixing pin hammering holes 33*f* being formed in a manner so as to each penetrate a pair of side walls of the column 33 opposing one another. In the present embodiment, the fixing pin hammering holes 33*f* are formed at two points in the vertical direction so that one hole penetrates one pair of opposing side walls of the column 33 and the other hole penetrates the other pair of side walls of the column 33. Furthermore, in the present embodiment, a pair of flat-head wood screw members 22 for reinforcement are screwed in and attached so as to be arranged on both sides of the column 33 so as to sandwich the hardware piece fixation hole 33*d*, the screw members 22 being provided at sections between the height-wise positions at which the fixing pin hammering holes 33*f* are formed and the height-wise position at which the locking pin hammering hole 33*e* is formed.

In the present embodiment, as illustrated in FIGS. 1, 3, 4A, and 4B, the groundsel-side hardware piece 11 attached to the groundsel 32 is a cylindrical hardware piece having an outer diameter of about 52 mm, for example, and has a length of about 170 mm, for example. The lower portion having a length of about 105 mm, for example, of the groundsel-side hardware piece 11 serves as the groundsel-embedded portion 14 and is fitted to the hardware piece fixation hole 32*a* in the groundsel 32 so as to be joined and fixed thereto. Thus, the upper portion having a length of about 65 mm, for example, of the groundsel-side hardware piece 11 serves as the upper fitting tenon portion 15, and the groundsel-side hardware piece 11 is attached to the groundsel 32 in a state where the upper fitting tenon portion 15 projects from the upper face of the groundsel 32. The groundsel-side hardware piece 11 is provided with a flange-shaped fastening step portion 13 that projects inward from the inner circumferential face at the boundary portion between the groundsel-embedded portion 14 and the upper fitting tenon portion 15, and that is continuous so as to form an annular shape. The groundsel-side hardware piece 11 is attached to the groundsel 32 in a state where the groundsel-side hardware piece 11 is firmly and tightly joined with the anchor bolt 31, by screwing a nut member 35*b* onto a portion of the upper-end male screw portion 31*a* of the anchor bolt 31 that projects further upward than the fastening step portion 13, while preferably interposing an eccentric washer 35*a* between the nut member 35*b* and the fastening step portion 13, thus fastening the nut member 35*b* to the fastening step portion 13.

Female screw holes 23 are formed in the circumferential face of the groundsel-embedded portion 14 of the groundsel-side hardware piece 11, at positions corresponding to the bolt insertion holes 32*e* that are formed in the end face 32*b* and the side face 32*c* of the end portion of the groundsel 32 and that are for attaching the later-described joint hardware pieces 20 and 21. Furthermore, a pair of pin locking holes 15*a* into which the driftpin 18 is hammered is provided in the circumferential face of the upper fitting tenon portion 15 of the groundsel-side hardware piece 11; the pin locking holes 15*a* are aligned with the pin locking hole 16*a* in the column-side hardware piece 12 and are arranged so as to face each other in the radial direction. Furthermore, the upper end face of the upper fitting tenon portion 15 of the groundsel-side hardware piece 11 is provided with a pair of rotation locking recess portions 15*b* that engage with and lock the rotation locking projecting portions 19*a* of the overhanging flange 19 of the column-side hardware piece 12 and that are arranged so as to face each other in the radial direction.

In the present embodiment, as illustrated in FIGS. 1, 3, 5A, and 5B, the column-side hardware piece 12 attached to the column 33 is a rod-shaped cylindrical hardware piece having an outer diameter of about 27.2 mm, for example, and has a length of about 150 mm, for example. The upper portion having a length of about 115 mm, for example, of the column-side hardware piece 12 serves as the column-embedded portion 17, and is fitted into the hardware piece fixation hole 33*d* of the column 33 so as to be joined and fixed thereto. Thus, with the lower end portion with a length of about 35 mm, for example, of the column-side hardware piece 12 serving as the lower projecting portion 16, the column-side hardware piece 12 is attached to the column 33 in a state where the lower projecting portion 16 projects downward from the top face portion 33*c* of the fitting hole 33*b*. The overhanging flange 19 having an annular shape is attached to the base end portion of the lower projecting portion 16 of the column-side hardware piece 12 by being joined by means of welding so as to come into tight contact with the top face portion 33*c* of the fitting hole 33*b*. The overhanging flange 19 has an outer diameter that is substantially the same as the inner diameter of the upper fitting tenon portion 15 of the groundsel-side hardware piece 11, and is provided with a pair of rotation locking projecting portions 19*a* that project outward from radially-opposing positions on the peripheral edge portion of the overhanging flange 19 and that are engaged in and locked by the rotation locking recess portions 15*b* of the groundsel-side hardware piece 11.

The column-embedded portion 17 of the column-side hardware piece 12 has fixing pin locking holes 17*a* formed at positions that match the fixing pin hammering holes 33*f*, which are formed in the base portion 33*a* of the column 33, in a state where the column-side hardware piece 12 is fitted into the hardware piece fixation hole 33*d* until the overhanging flange 19 comes into tight contact with the top face portion 33*c* of the fitting hole 33*b*. The fixing pin locking holes 17*a* are formed in a pair at two points in the vertical direction by drilling the holes 17*a* in perpendicularly intersecting directions. The column-side hardware piece 12 is firmly joined and fixed to the base portion 33*a* of the column 33 by hammering fixing pins, preferably driftpins 24, in a state where the fixing pin locking holes 17*a* are aligned with the respective fixing pin hammering holes 33*f* in the base portion 33*a* of the column 33.

Furthermore, the pin locking hole 16*a* is formed in a penetrating manner in the lower projecting portion 16 of the column-side hardware piece 12, with the central axis of the pin locking hole 16*a* aligned with that of the locking pin hammering hole 33*e* formed in the base portion 33*a* of the column 33.

In the present embodiment, as illustrated in FIGS. 1 to 3, joint hardware pieces 20 and 21, which are for joining the end face 32*b*' of another groundsel 32' and the end face 34*a* of a beam member 34 such as a sleeper, are attached to the end face 32*b* and the side face 32*c* of the end portion of the groundsel 32. The joint hardware pieces 20 and 21 have substantially the same configuration as that of the end-face joint hardware piece and the side-face joint hardware piece disclosed in JP2013-11134A, for example. More specifically, the joint hardware pieces 20 and 21 are plate-shaped hardware pieces that are processed so as to have a substantially U-shaped cross-sectional shape by, e.g., folding/bending a metal plate member. Each joint hardware piece 20, 21 has: a contact plate portion 20*a*, 21*a* constituted by the side portion in the middle of the substantially U-shaped cross-sectional shape; and projecting plate portions 20*b*, 21*b* constituted by the pair of side portions of the substantially U-shaped cross-sectional shape. The contact plate portions 20*a* and 21*a* respectively have positioning projecting portions 20*c* and 21*c* that are positioned at and placed in the respective bolt fastening recess portions 32*d* formed in the end face 32*b* and the side face 32*c* of the end portion of the groundsel 32; the positioning projecting portions 20*c*, 21*c* are formed so as to project outward. A bolt fastening hole is formed so as to be open at the center portion of each of the positioning projecting portions 20*c* and 21*c*.

Male screw portions 25*a* of respective fixing bolts 25 are inserted into the respective bolt insertion holes 32*e* formed in the end face 32*b* and the side face 32*c* of the end portion of the groundsel 32 via the respective bolt fastening holes in the positioning projecting portions 20*c* and 21*c*, and the inserted male screw portions 25*a* are screwed into the respective female screw holes 23 in the groundsel-embedded portion 14 of the groundsel-side hardware piece 11 that are aligned with the bolt insertion holes 32*e*; thus, head portions 25*b* of the respective fixing bolts 25 are fastened in the respective positioning projecting portions 20*c* and 21*c* and bolt fastening recess portions 32*d*. Thus, the joint hardware pieces 20 and 21 are firmly attached to the end face 32*b* and the side face 32*c* of the end portion of the groundsel 32 in a stable state.

In the present embodiment, the pairs of projecting plate portions 20*b* and 21*b* of the joint hardware pieces 20 and 21 respectively have driftpin engaging holes 20*d* and 21*d* and driftpin engaging cutouts 20*e* and 21*e* for locking driftpins 26, which are used at the time of joining the end face 32*b*' of the other groundsel 32' and the end face 34*a* of the beam member 34 to the end portion of the groundsel 32 via the joint hardware pieces 20 and 21. The driftpins 26 are hammered in via driftpin hammering holes 36 formed in the side face of the end portion of the other groundsel 32' and the end portion of the beam member 34, and are engaged in and locked by the driftpin engaging holes 20*d* and 21*d* and the driftpin engaging cutouts 20*e* and 21*e* of the joint hardware pieces 20 and 21, in a state where the end portion of the other groundsel 32' and the end portion of the beam member 34 are positioned with respect to the end portion of the groundsel 32 in a manner such that the joint hardware pieces 20 and 21 are placed in cut-out recess portions having a substantially-U-shaped cross-sectional shape and including pairs of parallel junction grooves 35 (see FIG. 2) formed in the end face 32*b*' of the other groundsel 32' and the end face 34*a* of the beam member 34, respectively. Thus, the end face 32*b*' of the other groundsel 32' and the end face 34*a* of the beam member 34 are firmly joined and fixed to the end portion of the groundsel 32 in a stable state.

Figure 6A:
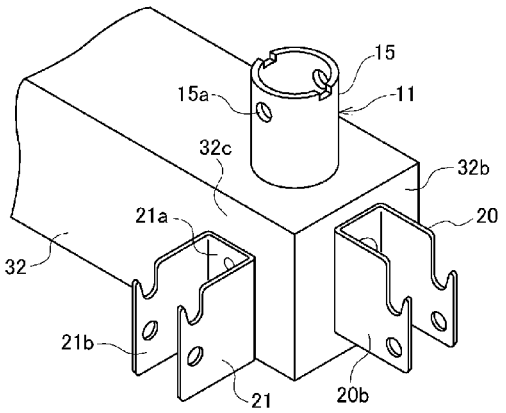
FIG. 6A is a perspective view for illustrating a state before the column is installed upright on the groundsel.

In the column base joint structure 10 in the present embodiment having the above-described configuration, at e.g. a construction site of a wooden residential building, the end face 32*b*' of the other groundsel 32' and the end face 34*a* of the beam member 34 are joined, as illustrated in FIGS. 1 and 3, to the end face 32*b* and the side face 32*c* of the groundsel 32 to which the joint hardware pieces 20, 21 have been attached to the end face 32*b* and the side face 32*c* of the groundsel's end portion and to which the groundsel-side hardware piece 11 has been attached in a state where the groundsel-embedded portion 14 is embedded in the placement hole 32*a* and the upper fitting tenon portion 15 projects upward, as illustrated in FIG. 6A. Furthermore, an underfloor panel 36 is provisionally laid so as to be supported by the upper faces of the groundsel 32, the other groundsel 32', and the beam member 34, and thus, a scaffold is formed such that, for example, a portion of the underfloor panel 36 where the column 33 is to be attached is left open.

Figure 6B:
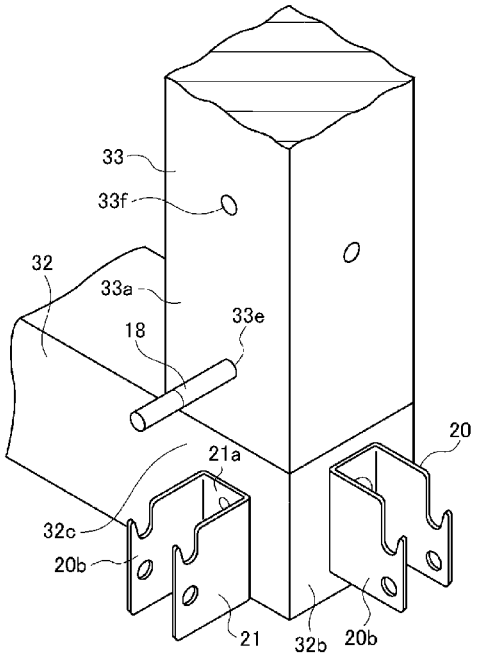
FIG. 6B is a perspective view for illustrating a state where the column is installed upright on the groundsel.

Thereafter, the anchor bolt 31 and the column 33 can be tightly joined to each other firmly and easily, with a simple operation of: fitting the upper fitting tenon portion 15, which projects from the upper face of the groundsel 32, into the fitting hole 33*b* in the base portion 33*a* of the column 33 to which the column-side hardware piece 12 is attached; arranging the overhanging flange 19 of the column-side hardware piece 12 on the inner side of the upper fitting tenon portion 15 while engaging and locking the overhanging flange 19 in the rotation locking recess portions 15*b* of the groundsel-side hardware piece 11 (see FIGS. 1 and 3); and, in a state where the column 33 is positioned so as to be installed upright on the upper face of the groundsel 32, hammering the driftpin 18 toward the pin locking holes 15*a* in the upper fitting tenon portion 15 of the groundsel-side hardware piece 11 and the pin locking hole 16*a* in the lower projecting portion 16 of the column-side hardware piece 12, the pin locking holes 15*a* and 16*a* being aligned with each other, via the locking pin hammering hole 33*e* formed in the base portion 33*a* of the column 33, as illustrated in FIG. 6B in which the other groundsel 32', the beam member 34, and the underfloor panel 36 are omitted.

Accordingly, with the column base joint structure 10 in the present embodiment, by using the groundsel-side hardware piece 11 and the column-side hardware piece 12 for tight joining that are embedded respectively in the base portion 33*a* of the column 33 and the groundsel 32, it is possible to tightly join the anchor bolt 31 and the column 33 to each other easily, even in a state where the underfloor panel 36 is provisionally laid on the upper face of the groundsel 32, for example, and it is also possible to join the end faces of the other groundsel 32' and the beam member 34 to—and to attach the joint hardware pieces 20 and 21 serving as a connector or a joint—to the side face 32*c* and the end face 32*b* in a section of the groundsel 32 where the column 33 is installed upright, without the need to consider the relationship between these parts and a hammering hole 33*e* into which the locking pin 31 is hammered.

Furthermore, according to the present embodiment, the column-side hardware piece 12 includes, at the base end portion of the lower projecting portion 16, the overhanging flange 19 having an outer diameter that is substantially the same as the inner diameter of the upper fitting tenon portion 15 of the groundsel-side hardware piece 11. Since the driftpin 18 is hammered into the aligned pin locking holes 15*a* and 16*a* in a state where the overhanging flange 19 is arranged on the inner side of the upper fitting tenon portion 15, the anchor bolt 31 and the column 33 can be tightly joined to each other in a more stable state.

Furthermore, according to the present embodiment, the rotation locking recess portions 15*b* are formed by making cuts in the upper end face of the upper fitting tenon portion 15 of the groundsel-side hardware piece 11, and the rotation locking projecting portions 19*a* are provided so as to project radially outward from the peripheral edge portion of the overhanging flange 19 of the column-side hardware piece 12. Since the overhanging flange 19 is arranged on the inner side of the upper fitting tenon portion 15 in a state where the rotation locking projecting portions 19*a* are engaged in and locked by the rotation locking recess portions 15*b*, it is possible to easily perform the operation of positioning and installing the column 33 upright on the upper face of the groundsel 32, and it is also possible to effectively prevent the position of the column 33 from shifting in a rotational direction with respect to the groundsel 32 after the column 33 is installed upright and until the driftpin 18 is hammered in.

Note that the present invention is not limited to the above embodiment, and various modifications may be made. For example, the groundsel-side hardware piece and the placement holes do not necessarily have to be provided at the end portion of the groundsel, and the column may also be installed upright on an intermediate portion of the groundsel that is other than the end portion. The joint hardware piece does not necessarily have to be attached to the side face or the end face of the portion of the groundsel to which the groundsel-side hardware piece is attached. The overhanging flange having the outer diameter that is the same as the inner diameter of the upper fitting tenon portion does not necessarily have to be provided at the base end portion of the lower projecting portion of the column-side hardware piece.

The invention claimed is:

1. A column base joint structure, comprising:

a column installed upright on a groundsel; and an anchor bolt having an upper-end male screw portion projecting from an upper face of a foundation are tightly joined to each other by using a groundsel-side hardware piece attached to the groundsel and a column-side hardware piece attached to the column, wherein:

the groundsel-side hardware piece is a tubular hardware piece placed in and fixed to a placement hole formed so as to vertically penetrate the groundsel, wherein the groundsel-side hardware piece includes, within a hollow interior thereof, a fastening step portion to which the anchor bolt is fastened, and the groundsel-side hardware piece has a groundsel-embedded portion that is embedded in the groundsel and an upper fitting tenon portion that projects upward from an upper face of the groundsel and in which a pin locking hole is formed;

the column has, in a lower end portion, a fitting hole into which the upper fitting tenon portion of the groundsel-side hardware piece is fitted, the fitting hole being formed by depressing a lower end face of the column in a mortise shape;

the column-side hardware piece is a rod-shaped hardware piece attached so as to extend along a central axis direction of the column, the column-side hardware piece having:

a lower projecting portion that has a pin locking hole and is formed so as to project downward inside the fitting hole formed in the column from a top face portion of the fitting hole; and a column-embedded portion that is embedded in and fixed to a portion of the column above the top face portion;

the anchor bolt and the column are tightly joined to each other by:

the anchor bolt is fastened to the fastening step portion of the groundsel-side hardware piece, such that the groundsel is fixed to the foundation;

the upper fitting tenon portion projecting from the upper face of the groundsel is fitted into the fitting hole, such that the column is installed upright on the groundsel;

inside the fitting hole, the pin locking hole in the upper fitting tenon portion of the groundsel-side hardware piece is aligned with the pin locking hole in the lower projecting portion of the column-side hardware piece;

a locking pin is hammered toward the pin locking holes aligned with one another inside the fitting hole via a locking pin hammering hole provided so as to penetrate a pair of opposing side walls of the column, such that the anchor bolt and the column are tightly joined; wherein the column-side hardware piece includes, at a base end portion of the lower projecting portion and a top end of the fitting hole, an overhanging flange provided so as to project outward from an outer circumferential face of the lower projecting portion, the overhanging flange having an outer diameter that is substantially the same as an inner diameter of the upper fitting tenon portion of the groundsel-side hardware piece, wherein the locking pin is hammered into the aligned pin locking holes in a state where the overhanging flange is arranged on an inner side of the upper fitting tenon portion; and wherein a rotation locking recess portion is formed by making a cut in an upper end face of the upper fitting tenon portion of the groundsel-side hardware piece; a rotation locking projecting portion is provided so as to project radially outward from a peripheral edge portion of the overhanging flange of the column-side hardware piece and the overhanging flange is arranged on the inner side of the upper fitting tenon portion in a state where the rotation locking projecting portion is engaged in and locked by the rotation locking recess portion.

2. The column base joint structure according to claim 1, wherein a joint hardware piece is attached to a side face or an end face of a portion of the groundsel to which the groundsel-side hardware piece is attached.

3. The column base joint structure according to claim 2, wherein:

a female screw hole is formed in a circumferential face of the groundsel-embedded portion of the groundsel-side hardware piece; and a male screw portion of a fixing bolt that fixes the joint hardware piece to the side face or the end face of the groundsel is fastened to the female screw hole.

4. The column base joint structure according to claim 1, wherein a joint hardware piece is attached to a side face or an end face of a portion of the groundsel to which the groundsel-side hardware piece is attached.

5. The column base joint structure according to claim 1, wherein a joint hardware piece is attached to a side face or an end face of a portion of the groundsel to which the groundsel-side hardware piece is attached.

6. The column base joint structure according to claim 1, wherein:

a fixing pin is in each fixing hole, and the fixing pin is a drift pin.

7. The column base joint structure according to claim 1, wherein:

a pair of flat-head wood screw members for reinforcement are screwed in and attached so as to be arranged on both sides of the column so as to sandwich a hardware piece fixation hole.

8. The column base joint structure according to claim 7, wherein:

the screw members are provided at sections between a plurality of height-wise positions at which fixing pin hammering holes are formed and the height-wise position at which a locking pin hammering hole is formed.

9. The column base joint structure according to claim 1, wherein:

female screw holes are formed in the circumferential face of the groundsel-embedded portion of the groundsel-side hardware piece, at positions corresponding to bolt insertion holes that are formed in an end face and a side face of an end portion of the groundsel and that are for attaching a plurality of joint hardware pieces.

10. The column base joint structure according to claim 1, wherein:

there are a pair of pin locking holes provided in a circumferential face of the upper fitting tenon portion of the groundsel-side hardware piece.

* * * * *